US005078044A

United States Patent [19]

Bourgie et al.

[11] Patent Number: 5,078,044

[45] Date of Patent: Jan. 7, 1992

[54] TURRET COMPRISING A ROTATING JOINT AND AN ANGULAR VELOCITY REDUCTION DEVICE

[75] Inventors: Paul Bourgie, Saint Arnoult en Yvelines; Guy Peltier, Verrieres le Buisson; Bernard Lochot, Meudon la Foret, all of France

[73] Assignee: Thomson-CSF, Paris, France

[21] Appl. No.: 596,554

[22] Filed: Oct. 12, 1990

Related U.S. Application Data

[63] Continuation of Ser. No. 385,997, Jul. 27, 1989, abandoned, which is a continuation of Ser. No. 130,213, Dec. 8, 1987, abandoned.

[30] Foreign Application Priority Data

Dec. 9, 1986 [FR] France ..... 86 17207

[51] Int. Cl.[5] ..... F41G 5/14

[52] U.S. Cl. ..... 89/41.02; 89/41.22; 89/41.06

[58] Field of Search ..... 89/1.815, 40.03, 41.01, 89/41.02, 41.22, 41.05, 41.06; 74/804

[56] References Cited

U.S. PATENT DOCUMENTS

| | | | |
|---|---|---|---|
| 2,366,072 | 12/1944 | Tucker et al. | 89/41.02 |
| 2,414,608 | 1/1947 | Pontius, III | 89/37.5 |
| 2,966,808 | 1/1961 | Grudin | 74/804 |
| 3,190,148 | 6/1965 | Flichy | 74/804 |
| 3,826,383 | 7/1974 | Richter | 414/730 |
| 4,004,487 | 1/1977 | Eichweber | 89/1.815 |
| 4,518,308 | 5/1985 | Grzybowski et al. | 74/640 |
| 4,574,659 | 3/1986 | Arndt | 74/804 |
| 4,576,085 | 3/1986 | LeBlanc | 89/36.13 |
| 4,622,554 | 11/1986 | Gellekink et al. | 342/67 |

FOREIGN PATENT DOCUMENTS

| | | | |
|---|---|---|---|
| 2322631 | 3/1974 | Fed. Rep. of Germany | 244/3.16 |
| 2186331 | 1/1974 | France . | |
| 2484627 | 12/1981 | France . | |
| 9373 | of 1887 | United Kingdom | 89/41.01 |

OTHER PUBLICATIONS

United Shoe Machiner, 1962, Beverly, Mass., U.S.A.; "Harmonic Drive".

*Primary Examiner*—Deborah L. Kyle
*Assistant Examiner*—Stephen Johnson
*Attorney, Agent, or Firm*—Oblon, Spivak, McClelland, Maier & Neustadt

[57] ABSTRACT

A turret comprising a rotating joint and an angular velocity reduction device is disclosed. A tracking turret comprises an angular velocity reduction device with an elliptical wave generator, an externally-toothed flexible ring and an internally-toothed rigid ring, and a rotating joint used for the transmission of electrical signals. The invention can be applied chiefly to the making of close-range anti-aircraft defense turrets.

5 Claims, 3 Drawing Sheets

FIG_2
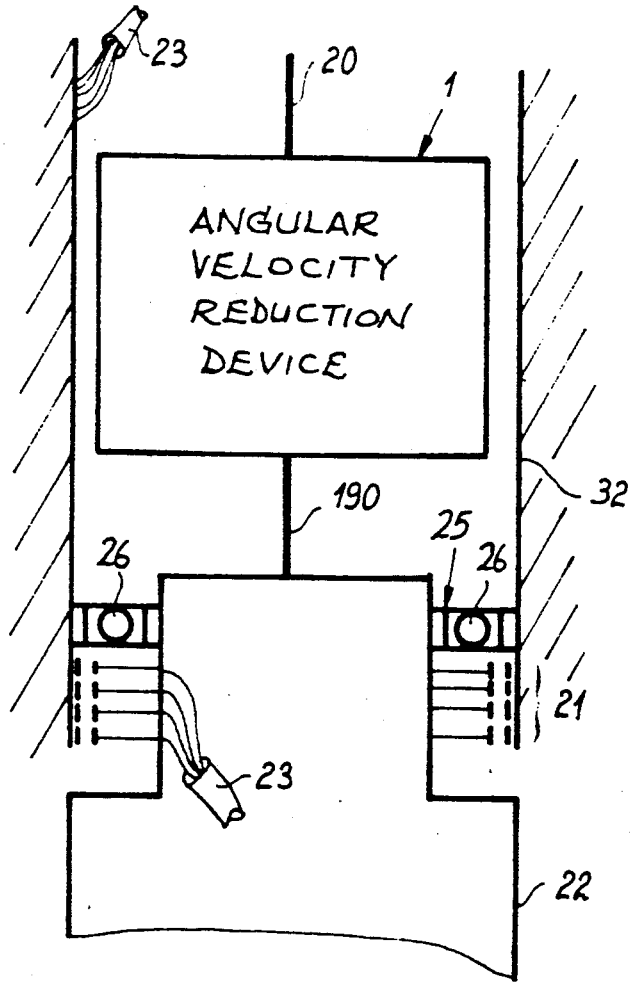
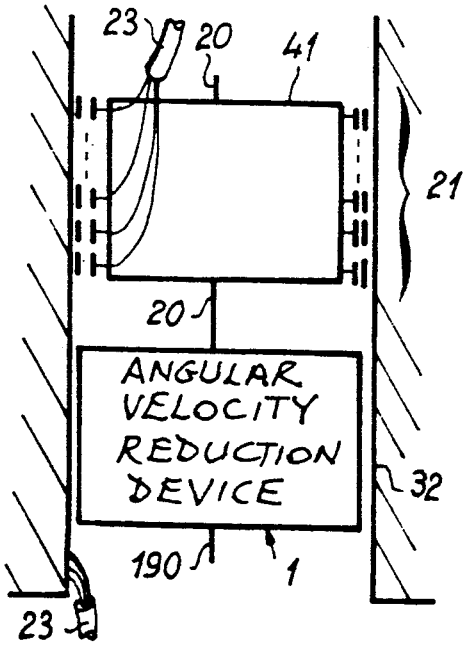
FIG_3

FIG_4
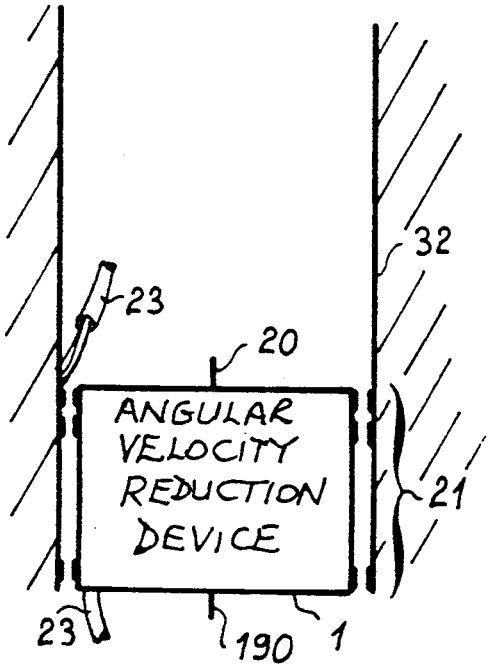
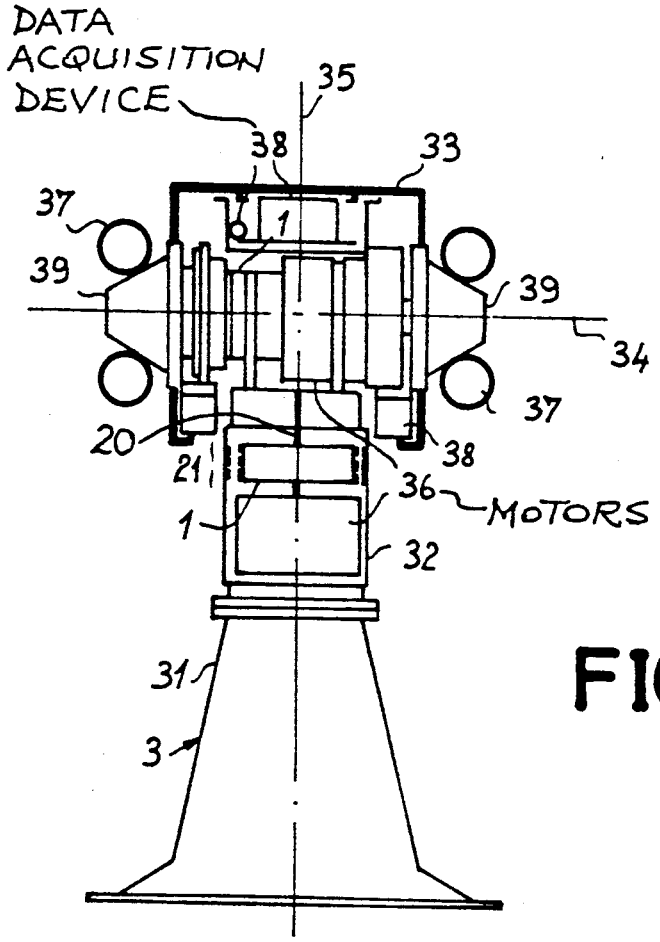
FIG_5

TURRET COMPRISING A ROTATING JOINT AND AN ANGULAR VELOCITY REDUCTION DEVICE

This application is a Continuation of application Ser. No. 07/385,997, filed on JULY 27, 1989, now abandoned, which is a Continuation of application Ser. No. 07/130,213 filed on DEC. 8, 1987 now abandoned.

BACKGROUND OF THE INVENTION

1. Field of the Invention

The invention pertains to a turret comprising a rotating joint and an angular velocity reduction device.

2. Description of the Prior Art

The making of tracking turrets carrying weapon systems is known in the prior art. Turrets of this type must be capable of motion in terms of both elevation and relative bearing so that they can track targets. Anti-aircraft defense turrets must be extremely agile so as to be able to track aircraft in elevation and relative bearing for close-range anti-aircraft defence. It is imperative that a turret of this type should be capable of making more than one full rotation in relative bearing when tracking a revolving target.

The prior art also includes methods in robotics for using angular velocity reduction devices comprising, on one and the same axis, a fixed, substantially cylindrical hollow part fitted with gear teeth on its internal surface, a toothed wheel of changeable shape having two teeth less than the hollow part and providing the drive at reduced angular velocity, the said devices further comprising a substantially elliptical part capable of changing the shape of the toothed wheel of changeable shape.

Angular velocity reduction devices of this type have the advantage of low mass, very high angular velocity reduction ratio and compactness. The robot arm fitted with a reduction device of this type has a wiring for the transmission of electrical signals. The wiring both powers the actuators electrically and collects data transmitted by sensors. The wiring does not allow the robotic arm to rotate completely on its axis. This does not raise any problem for a robot inasmuch as, for the performance of its work, the absolute position with respect to a fixed reference point of the robotic arm must imperatively be known with great precision. By contrast, for a tracking turret comprising detection devices and/or weapons, it is essential to possess the ability to obtain a relative reference with respect to the position of the target and not a absolute reference with respect to a fixed reference. Of course, it is possible to fit a turret with an angle encoder for example. For example, a digital angle encoder with a resolution of 16 bits is used.

3. Summary of the Invention

The turret of the present invention has an axial angular velocity reduction device, providing a high reduction ratio, the said device being associated with a rotating joint that transmits the electrical signals needed for the proper functioning of the turret without hampering its rotation in relative bearing. The low mass of the angular velocity reduction device makes possible the construction of highly agile, low-inertia turrets. The reduction in the volume of the turrets makes them smaller and therefore less easily identifiable by the enemy.

Furthermore, since the angular velocity reduction device is on the rotational axis of the turret, it is easily interchangeable. The velocity reduction device can be suited precisely to the reduction ratios required and the mechanical power values that it has to transmit. The angular velocity reduction device will be chosen according to the weapons system used with which the turret is equipped, and especially according to the mass of the said weapons system, as well as according to the the maximum rotational velocity and, consequently, the power of the drive motors.

Thus, for each weapons system it is possible to make an optimum turret in which inertia and costs are reduced to the minimum.

Furthermore, an existing turret can be adapted and optimized to suit a new weapons system.

The main object of the invention is a turret with two degree of freedom comprising a rotating joint, two drive motors, each drive motor being mechanically coupled with a rotational velocity reduction device, wherein the rotational velocity reduction devices comprise a fixed, substantially cylindrical hollow part fitted with a toothing on its inner surface, a toothed wheel capable of changing its shape, comprising fewer teeth than the hollow part, coupled mechanically with the part of the turret that has to be driven and a substantially elliptical part coupled mechanically with the toothed wheel by a ball bearing, the said substantially elliptical part being capable of changing the shape of the toothed wheel so as to establish contact between the wheel and the hollow part at two opposite points.

BRIEF DESCRIPTION OF THE DRAWINGS

The invention will be better understood from the following description and the appended figures, given as non-exhaustive examples, of which:

FIG. 2 is a drawing of a first embodiment of the arrangement of a rotating joint and an angular velocity reduction device;

FIG. 3 is a drawing of a second embodiment of the arrangement of a rotating joint and an angular velocity reduction device FIG. 4 is a drawing of a third example of an embodiment of the arrangement of a rotating joint and an angular velocity reduction device;

FIG. 5 is a diagram of an embodiment of a turret according to the present invention.

FIGS. 1 to 5 repeat the same references for the same elements.

DESCRIPTION OF PREFERRED EMBODIMENTS

FIG. 1 shows a cross-section of a rotational velocity reduction device used in the device according to the present invention.

Figure 1A:
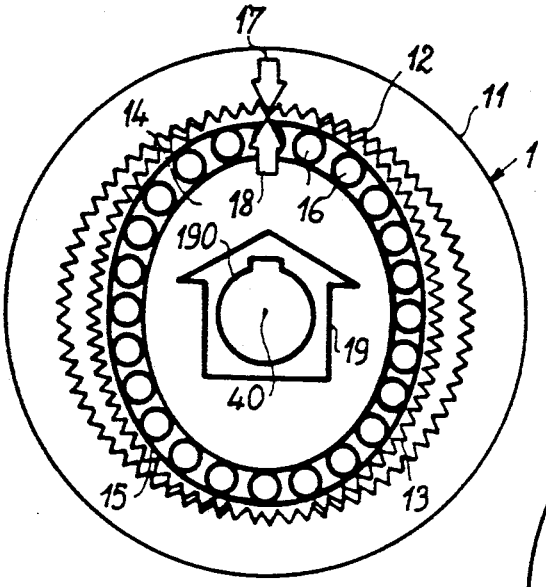
FIG. 1 is a drawing of an angular velocity reduction device used in the turret according to the present invention.
Figure 1B:
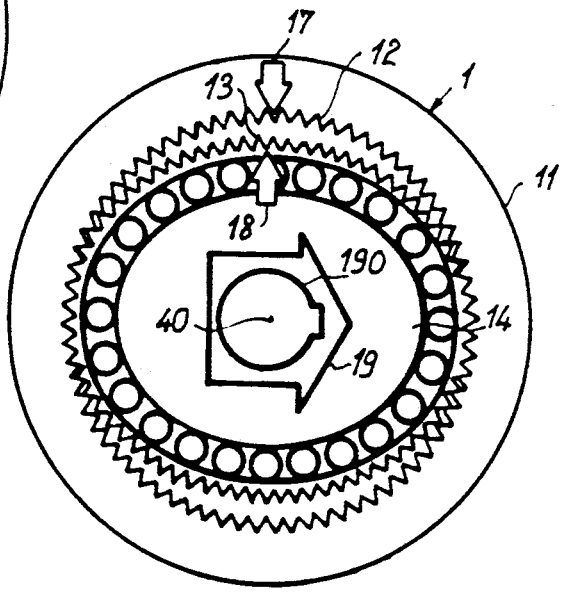
Figure 1C:
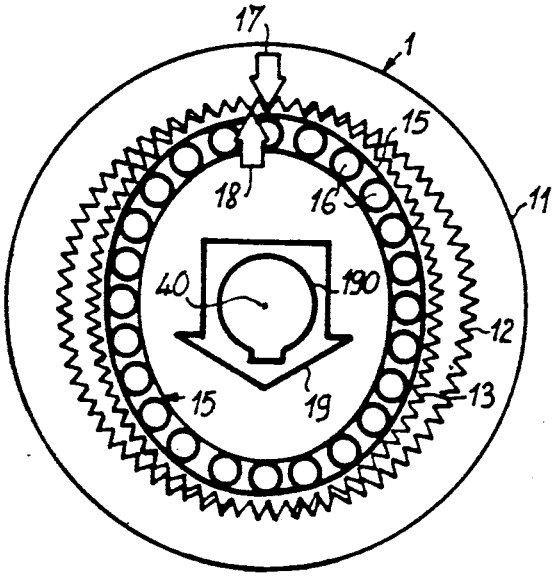
Figure 1D:
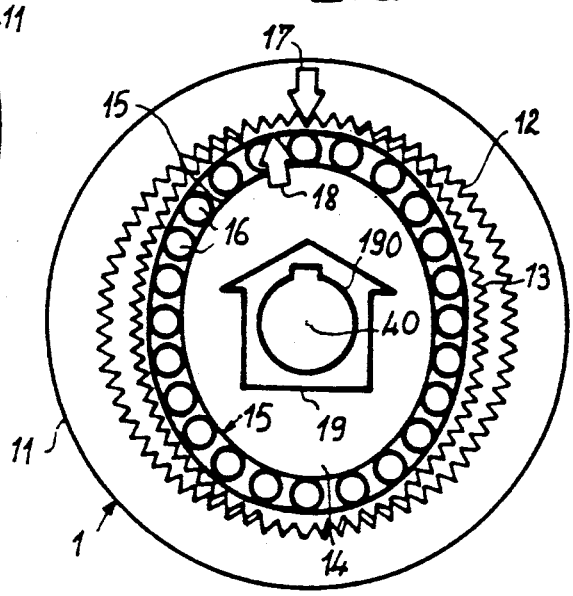

FIGS. 1*a*, 1*b* and 1*c* correspond to the various stages of one full rotation.

The arrow 17 indicates the angular position of the fixed part 11.

The arrow 18 indicates the angular position of the rotating part 13.

The arrow 19 indicates the angular position of the drive shaft 190 of an elliptic wave generator 14.

The angular velocity reduction device shown in figure 1 is marketed by the Harmonic Drive Company.

The angular velocity reduction device 1 comprises an elliptic wave generator 14, an externally-toothed flexible ring 13 and an internally-toothed rigid ring 11. The elliptic wave generator 14 is connected by a ball bearing 15 to the externally-toothed flexible ring 13. The elliptical wave generator has a drive shaft 190. The elliptical wave generator 14 is capable of changing the shape of the externally-toothed flexible ring 13 so that about 15% of the teeth of this ring opposite the axis of the set are in contact with the teeth of the internally-toothed rigid ring 11.

The toothing 12 of the rigid ring 11 as well as the externally-toothed ring 13 have the same module. However, to obtain a reduction ratio, the toothings 12 and 13 have different numbers of teeth. The reduction ratio i is given by the formula:

$$i=(N(13)-N(12))/N(13)$$

In one embodiment, the flexible ring 13 has two teeth In this case, i is a negative number inasmuch as the parts 11 and 13 rotate in opposite directions.

During the rotation of the elliptical wave generator 14, this generator changes the shape of the flexible ring 13 with external toothing. The teeth of the flexible ring 13 with external toothing, which come into contact with the teeth of the internal toothing 12 of the rigid ring 11, are substantially on the large axis of the ellipse of the elliptical wave generator 14. The use of a ball bearing 15 reduces friction losses when the externally-toothed flexible ring 13 has its shape changed.

FIG. 2 shows a first example of an embodiment of the transmission of motion and of electrical signals in a turret according to the present invention. The turret has a fixed footing 22. This footing has a motor (which cannot be seen in FIG. 2) connected by a shaft 190 to an angular velocity reduction device 1. A shaft 20 has a smaller rotational velocity than the shaft 190, but it has a greater torque. Below the angular velocity reduction device 1, there is a rotating joint 21 which transmits electrical signals. The number of tracks of the rotating joint is suited to the number of electrical signals to be transmitted while the width of each track is suited to the maximum intensity which can to be transmitted. Thus, the track lengths of the motor power supply units will be far greater than that needed for the return of a video signal coming from a camera on the turret.

The rings of the rotating joint 21 have, for example, brushes or filaments which rub against the circular tracks and are placed, for example, on the moveable part 32 of the turret. Cables 23 ensure the incoming and outgoing of the wires at the rotating joint 21.

Advantageously, the cable 23 has all the shielding facilities required to do away with couplings between the various electrical signals transmitted.

The moveable part 32 is connected, for example, to a bearing 25 with balls 26 at the fixed part 22 of the turret.

FIG. 3 shows an alternative embodiment in which the rotating joint 21 is placed above the device of the embodiment shown in FIG. 2. The circular metal rings are placed on the fixed part 22 of the turret. For example, insulated metal tracks are used to convey energy to these rings from a cable 23 which is joined to the fixed part of the turret. The brushes or filaments of the rotating joint 21 are set on a cylinder 41 placed on the shaft 20 at the outgoing of the angular velocity reduction device 1.

FIG. 4 shows an alternative embodiment of the device according to the present invention in which the rotating joint 21 is placed on the edge of the internally-toothed rigid ring 11 of the rotational velocity reduction device 1.

FIG. 5 shows an example of an embodiment of the turret according to the present invention. The turret shown in FIG. 5 has two degrees of freedom. It can rotate horizontally around a vertical axis 35 and vertically around a horizontal axis 34. The turret 3 of the present invention has a weapons system 37 and/or data acquisition devices 38.

The weapons system 37 may comprise, for example, anti-aircraft missiles, guns, or machine guns. The missiles may have, for example, passive infra-red homing devices.

The data acquisition devices may comprise, for example, laser telemeters, infra-red or visible light television cameras. The data acquisition devices are used for the detection and tracking of targets.

The turret 3 according to the present invention has the devices 39 needed to use the weapons systems 37. For example, the device 39 comprises the missile-launching system.

Advantageously, the turret 3 according to the present invention has two electrical drive motors 36 which drive the moveable part 32 around the axis 35 and also make a part of the turret 3 rotate on the axis 34. The motors 36 are connected to the angular velocity reduction devices 1.

The turret 3 according to the present invention can be mounted on vehicles, for example on cross-country light vehicles or on light armored vehicles.

A vehicle comprising a turret 3 is not beyond the scope of the present invention.

The turret of the present invention has the advantage of being highly modular so that it can be adapted to various weapons systems. Non-exhaustive examples of such systems include missiles, for example laser-guided missiles, or guns.

Furthermore, the turret according to the present invention may be advantageously used in warships. For example, the turrets of the present invention may provide anti-aircraft, anti-missile and/or naval defence for small surface vessels.

For large vessels, the turrets of the present invention can also advantageously provide close-range anti-aircraft and anti-missile defence.

The invention can be applied especially to the making of target-tracking turrets.

The invention applies mainly to the making of close-range anti-aircraft defence turrets.

What is claimed is:

1. A turret system carrying at least one weapon system, said turret system comprising:

a turret;

a first drive motor having a motor shaft for moving a first movable portion of said turret in a first degree of freedom wherein said first drive motor is mechanically coupled with a first harmonic drive rotational velocity reduction device and wherein said first drive motor is further mechanically coupled with a rotating joint wherein said rotating joint includes a means for transmission of electrical signals and energy between at least one fixed device associated with a fixed portion of said turret and at least oen other device associated with said first movable portion of said turret and wherein one part of said rotating joint is fixed on said turret and another part of said rotating joint is both coaxial with said motor shaft and fixed on a driving means;

a second drive motor for moving a second movable portion of said turret in a second degree of freedom wherein said second drive motor is mechanically coupled with a second harmonic drive rotational velocity reduction device.

2. A turret according to the claim 1 comprising one of target detection and tracking means.

3. A turret according to the claim 2 comprising video cameras sensitive to one of visible and infra-red radiation.

4. A turret according to the claim 2, comprising a laser telemeter.

5. A turret according to the claim 1 wherein the said turret is an anti-aircraft defence turret.

* * * * *